United States Patent [19]

Parsons

[11] 4,346,573

[45] Aug. 31, 1982

[54] FLUID PRESSURE SERVOMOTOR

[75] Inventor: David Parsons, Kenilworth, England

[73] Assignee: Automotive Products Limited, Leamington Spa, England

[21] Appl. No.: 83,223

[22] Filed: Oct. 10, 1979

[30] Foreign Application Priority Data

Oct. 12, 1978 [GB] United Kingdom ..... 40375/78

[51] Int. Cl.[3] ..... E05B 53/00; E05B 51/00

[52] U.S. Cl. ..... 70/264; 70/275; 92/48; 92/64

[58] Field of Search ..... 70/264, 275; 92/63, 92/64, 48; 91/167 R

[56] References Cited

U.S. PATENT DOCUMENTS

| | | | |
|---|---|---|---|
| 3,602,019 | 8/1971 | Kazaoka et al. | 70/264 |
| 3,630,305 | 12/1971 | Zazaoka et al. | 70/264 X |
| 3,633,391 | 1/1972 | Sindelfingen | 70/264 |
| 3,777,625 | 12/1973 | Andres | 92/48 |
| 4,000,226 | 12/1976 | Laprade et al. | 92/48 |
| 4,181,065 | 1/1980 | Benjamin | 92/48 X |

*Primary Examiner*—William E. Lyddane

*Attorney, Agent, or Firm*—Kemon & Estabrook

[57] ABSTRACT

A fluid pressure servo motor comprises a body having two operatively independent fluid chambers each chamber having therein a piston means movable in response to a fluid pressure differential so as to alter in use a two condition device from one to the other of said two conditions. The two piston means each have a lost motion means connection with the device to allow idle return of the pistons on cessation of the pressure differential. The two chambers and their respective pistons are co-axial and the pistons work in opposition to each other, one piston being fixed to a stirrup which bridges the other piston and acts in use against the two condition device, while allowing said other piston to move independently of the stirrup. Also disclosed is a vehicle door locking system incorporating servo motors as described.

8 Claims, 2 Drawing Figures

FLUID PRESSURE SERVOMOTOR

Figure 1:
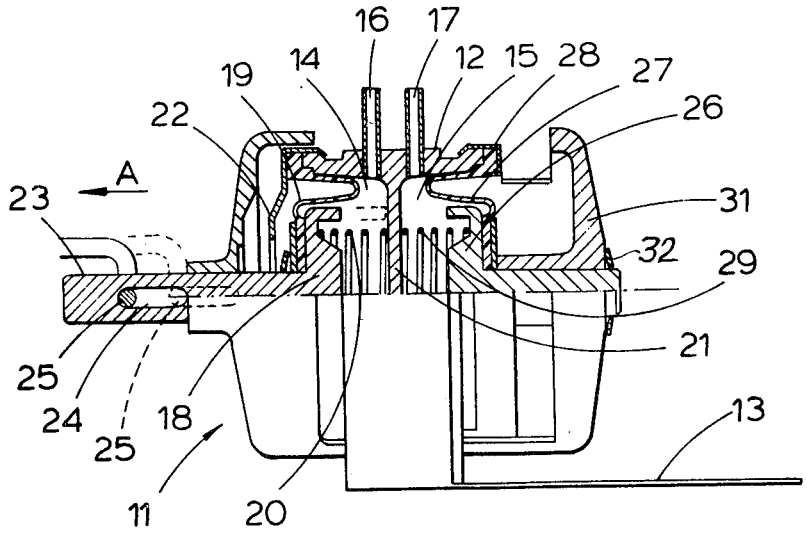

This invention relates to fluid pressure servo motors that in use move a two position device from one to the other of said two positions. Such actuators are particularly useful for moving door lock mechanisms on motor vehicles, from a locked condition to an unlocked condition or vice versa.

The use of vacuum operated servo motors for locking and unlocking of motor vehicle doors is well known. Examples of typical vacuum servo motors are illustrated in British Pat. Nos. 1,226,898 and 1,259,487. The servo motors illustrated in these patents comprise two independently operated fluid chambers separated by a single diaphragm which moves in response to a partial vacuum being created in one or other of the two chambers. The actuation rod which connects the diaphragm to the lock mechanism has to pass through an end wall of one of the fluid chambers and thus there is a problem with sealing the movable rod relative to the vacuum chamber wall.

The herein disclosed servo motor provides a construction in which the problem of actuation rods moving relative to stationary seals has been eliminated.

This invention also relates to multi-lock locking systems incorporating such actuators.

According to this invention there is provided a fluid pressure servo motor having two operatively independent fluid chambers, each chamber having therein a phragm 19. The diaphragm 19 seals at its outer periphery against the housing 12 and at its inner periphery against the piston 18. The piston 18 is biased away from the wall 21 by a spring 20 acting therebetween. The movement of the piston 18 away from the wall 21 is limited by a ring 22 which also serves to crimp the outer periphery of the diaphragm 19 against the housing 12.

The piston 18 also has a co-axial stem 23 projecting from the back face thereof (as shown). The stem 23 has an axially elongated slot 24 therein; the slot 24 in use engaging loosely with a member 25 of a lock mechanism such that there is some axial play between the member 25 and the ends of the slot 24. This loose play constitutes a lost motion connection between the first piston 18 and the lock member 25.

The second fluid chamber 15 houses a second piston 26 also carrying a diaphragm 27 secured at its outer periphery to the housing 12 by a crimping ring 28 and sealing at its inner periphery against the piston 26. A spring 29 biases the piston 26 away from the partition wall 21, such that the two pistons 18 and 26 are biased apart by the springs 20 and 29, and when a vacuum or pressure reduction acts in one or other of the chambers 14 and 15 the respective piston is moved towards the wall 21. Thus the two pistons can be said to be operating in opposition to one another.

Figure 2:
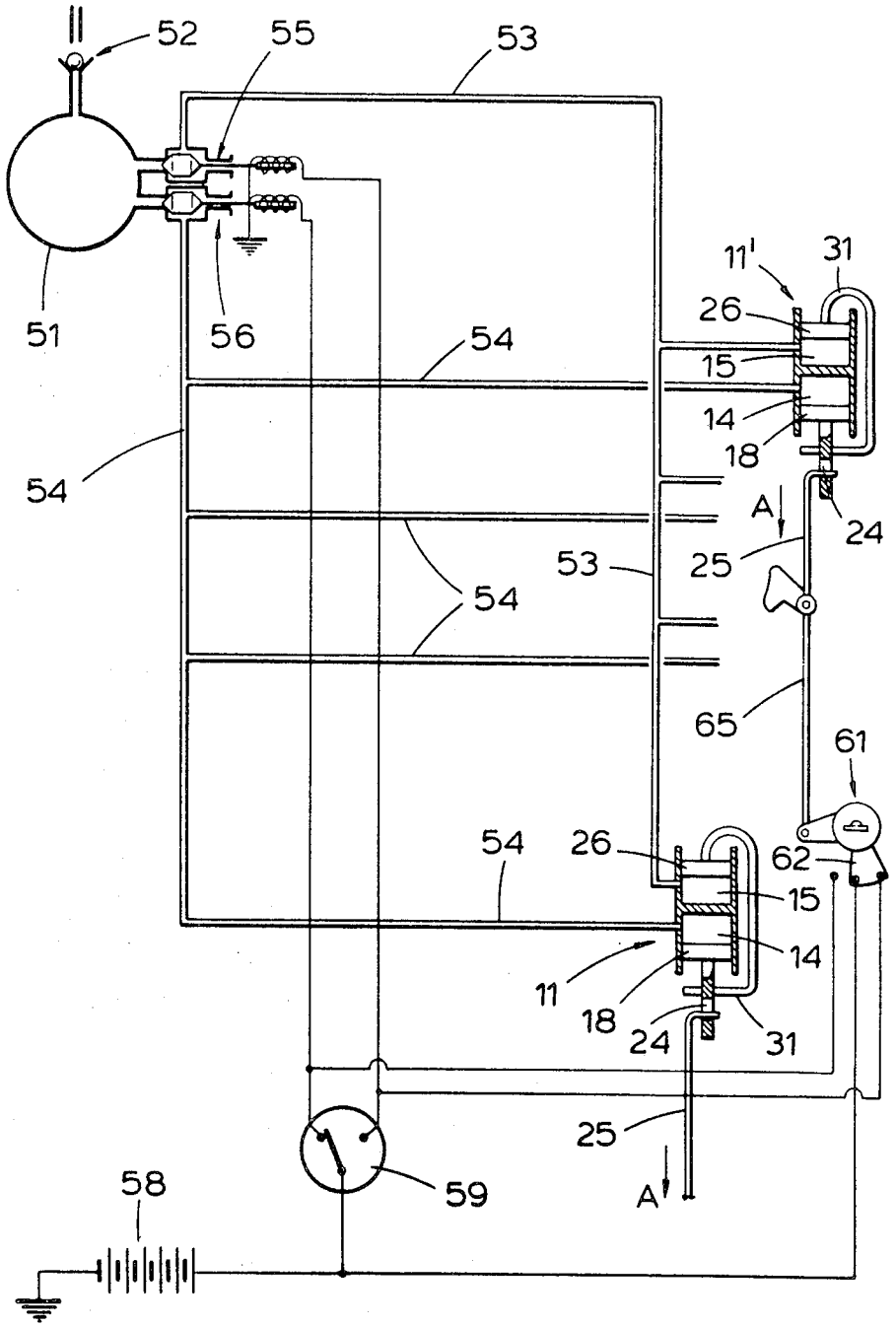

The piston 26 is fixed to the inside of one leg of a stirrup 31 by a suitable clip 32 which bridges the housing 12 and first piston 18, so that the other leg of the 15 respectively of a plurality of servomotors 11. In FIG. 2 only two servomotors are shown but may be at least four servomotors, one per door lock on a four door car.

The power for the solenoids is provided by the battery 58 of the vehicle and the solenoid valves 55 and 56 are operated by central control switches, a first switch 59 accessible within the passenger compartment of the vehicle and a second switch 62 associated with the driver's door lock 61. There may also be another switch on the front passenger door lock.

With the vehicle unlocked, as in FIG. 2, to lock the doors the solenoid 56 only is energized to pull the associated valve away from the reservoir 51. This shuts off the air and connects the vacuum via the conduit 54 with first members 14 of the servomotors 11. The solenoid 56 is actuated by either the spring loaded switch 59 within the car or by the switch 61 associated with the driver's lock.

When a vacuum acts within the chambers 14 the associated lock members 25 are moved counter to the direction of arrow A to lock all the respective locks. When the switch 59 or 61 is released the solenoid 56 de-energizes, the associated valve moves to cut-off the vacuum and allows air to re-enter the conduits 54. The pistons 18 of the servomotor return to their original positions, as described previously, without disturbing the locked state of the door.

To unlock the doors the solenoid 55 is energized, again through either of the spring loaded switches 59 or 61 which are moved to energize the solenoid 55 without energizing the solenoid 56 at the same time. The valve associated with the solenoid 55 closes to shut off the air supply and connect the vacuum reservoir with the chambers 15 of the servomotors via the conduit 53. This causes the pistons 26 to move the respective stirrups 31 to return the lock members 25 in the direction of arrow A without disturbing the first pistons 18, since the lost motion connection 24 accommodates such movement.

All doors have a normal manual operation, only the driver's door lock 62 is shown with a manual over-ride 65 with the respective lock so that if the vacuum fails or the electrical supply to the solenoid fails the driver's door can be locked or unlocked as is necessary.

I claim:

1. A fluid pressure servo motor comprising:

a stationary body;

two co-axial fluid chambers defined within the body and which are separated by a partition wall and are operatively independent;

a pair of co-axial piston means;

each of said piston means being located in a respective one of said chambers and being movable towards the partition wall in response to a pressure differential in the respective chamber, so as, in use, to effect alteration of a two condition device from one to the other of said conditions and each piston means having a lost motion means connection with said device to allow idle return of the piston means in the event of cessation of the pressure differential; and a stirrup fixed to one of said two piston means and operatively bridging the other of said two piston means to act in use against said device while allowing said other piston means to move axially independently of the stirrup.

2. A servo motor as claimed in claim 1, wherein the stirrup slidably supports the piston means which it bridges.

3. A servo motor as claimed in claim 2, wherein the piston means bridged by the stirrup has a stem with an axially elongated slot therein for engagement with said device to move it into one condition when the bridged piston means is actuated, and the stirrup is engageable via an abutment surface thereon with the device to return said device to its original condition on actuation of the piston means carrying the stirrup.

4. A servo motor as claimed in claim 1, wherein each piston means is spring loaded to return to an "at rest" position when the pressure differential ceases.

5. A door locking system for a motor vehicle including at least one servo motor as claimed in any proceeding claim.

6. A door locking system as claimed in claim 5, wherein the pressure differential across each piston means is provided by a pressure reduction in the chamber relative to the atmosphere.

7. A locking system as claimed in claim 6, wherein the locking and unlocking operations of the servo motors are controlled by a respective solenoid-operated valve, for effecting the pressure reduction, and both solenoids are operated by a control switch which engages only one solenoid, at any time, to cause the system to lock or unlock.

8. A system as claimed in claim 7, wherein the servo motors are operable from a first central switch accesible inside a vehicle to the driver thereof and a second central switch is associated with the motor vehicle driver's door lock.

* * * * *